US005244947A

United States Patent [19]

Nohr et al.

[11] Patent Number: 5,244,947

[45] Date of Patent: Sep. 14, 1993

[54] STABILIZATION OF POLYOLEFIN NONWOVEN WEBS AGAINST ACTINIC RADIATION

[75] Inventors: Ronald S. Nohr, Roswell; John G. MacDonald, Decatur, both of Ga.

[73] Assignee: Kimberly-Clark Corporation, Neenah, Wis.

[21] Appl. No.: 815,688

[22] Filed: Dec. 31, 1991

[51] Int. Cl.[5] ..... C08K 5/54

[52] U.S. Cl. ..... 524/91; 428/289; 524/100; 524/102

[58] Field of Search ..... 524/100, 102, 91; 428/289

[56] References Cited

U.S. PATENT DOCUMENTS

| | | | |
|---|---|---|---|
| 3,016,599 | 1/1962 | Perry | 28/78 |
| 3,341,394 | 9/1967 | Kinney | 161/72 |
| 3,655,862 | 4/1972 | Dorschner | 264/290 |
| 3,692,618 | 9/1972 | Dorschner | 161/72 |
| 3,704,198 | 11/1972 | Prentice | 161/148 |
| 3,705,068 | 12/1972 | Dobo | 156/141 |
| 3,755,527 | 8/1973 | Keller | 264/210 |
| 3,802,817 | 4/1974 | Matsuki | 425/66 |
| 3,849,241 | 11/1974 | Butin | 161/169 |
| 3,853,651 | 12/1974 | Porte | 156/73.6 |
| 3,978,185 | 8/1976 | Buntin | 264/93 |
| 4,064,605 | 12/1977 | Akiyama | 28/103 |
| 4,091,140 | 5/1978 | Harmon | 428/288 |
| 4,100,319 | 7/1978 | Schwartz | 428/171 |
| 4,100,324 | 7/1978 | Anderson | 428/288 |
| 4,118,531 | 10/1978 | Hauser | 428/224 |
| 4,340,563 | 7/1982 | Appel | 264/518 |
| 4,405,297 | 9/1983 | Appel | 425/72 |
| 4,434,204 | 2/1984 | Harman | 428/198 |
| 4,627,811 | 12/1986 | Greiser | 425/72 |
| 4,644,045 | 2/1987 | Fowells | 526/348 |
| 4,663,220 | 5/1987 | Wisneski | 428/221 |
| 4,859,759 | 8/1989 | Maycock et al. | 528/27 |
| 4,920,168 | 4/1990 | Nohr et al. | 524/188 |
| 4,923,914 | 5/1990 | Nohr | 524/99 |
| 5,051,458 | 9/1991 | Costanzi et al. | 524/99 |

OTHER PUBLICATIONS

V. A. Wente, "Superfine Thermoplastic Fibers", vol. 48, No. 8, pp. 1342-1346 (1956).

V. A. Wente et al., "Manufacture of Superfine Organic Fibers", NRL Report 4364 (111437), dated May 25, 1954.

Robert R. Butin and Dwight T. Lohkamp, "Melt Blowing—A One-Step Web Process for New Nonwoven Products", vol. 56, No. 4, pp. 74-77 (1973).

*Primary Examiner*—Veronica P. Hoke

[57] ABSTRACT

A method of stabilizing a polyolefin nonwoven web against actinic radiation which involves the steps of (a) melting a mixture of a thermoplastic polyolefin, a first additive, and a second additive; (b) forming fibers by extruding the resulting melt through a die at a shear rate of from about 50 to about 30,000 $sec^{-1}$ and a throughput of no more than about 5.4 kg/cm/hour; (c) drawing the fibers; and (d) collecting the fibers on a moving foraminous surface as a web of entangled fibers. The first additive is a benzotriazolyl-containing polydialkylsiloxane having a molecular weight in the range of from about 500 to about 1,400 and a polydispersity of from about 1.3 to about 2.5. The second additive is a polyalkylpiperidyl-containing polydialkylsiloxane having a molecular weight in the range of from about 1,500 to about 30,400 and a polydispersity of from about 1.3 to about 3.0.

9 Claims, No Drawings

STABILIZATION OF POLYOLEFIN NONWOVEN WEBS AGAINST ACTINIC RADIATION

CROSS-REFERENCE TO RELATED APPLICATION

The application of the principles of the present invention to filaments, tow, and webs prepared by hydraulic spinning is described and claimed in copending and commonly assigned application Ser. No. 07/817,267 pending, entitled FILAMENTS, TOW, AND WEBS FORMED BY HYDRAULIC SPINNING AND HAVING DELAYED WETTABILITY and filed of even date in the names of Ronald Sinclair Nohr, Richard Allen Anderson, and John Gavin MacDonald.

BACKGROUND OF THE INVENTION

The present invention relates to the stabilization of polyolefin nonwoven webs. More particularly, the present invention relates to the stabilization of polyolefin nonwoven webs against the deleterious effects of actinic radiation.

Nonwoven webs are employed in a wide variety of applications, with the largest category being disposable absorbent products. However, nonwoven webs also are found in products which are intended for use in an external environment, i.e. outdoors. Examples of such products include agricultural row covers, tent fabrics, protective automobile covers, and the like. Many of these products are exposed to sunlight for long periods of time. Consequently, such products often must be stable against the deleterious effects of actinic radiation, especially ultraviolet radiation.

It has been known for many years that nonwoven webs prepared from thermoplastic polymers can be given some degree of stability by incorporating a stabilizer into the polymer. Such stabilizers typically are distributed through out the bulk of the fibers. While such stabilizers have a degree of effectiveness, relatively high concentrations often must be used in order to get a sufficiently high degree of stabilization.

A novel way to avoid the use of high stabilizer concentrations is described in U.S. Pat. No. 4,923,914 to Nohr et al., which patent is incorporated herein by reference. The patent describes a surface-segregatable, melt-extrudable thermoplastic composition which comprises at least one thermoplastic polymer and at least one defined additive. The additive can be a polysiloxane having a benzotriazolyl substituent or a tetraalkylpiperidyl substituent. Benzotriazoles are known absorbers of ultraviolet radiation, whereas tetraalkylpiperidines are known to function by deactivating excited oxygen molecules or terminating free radicals.

Upon being melt-extruded, the compositions of U.S. Pat. No. 4,923,914 result in fibers having a differential, increasing concentration of the additive from the centers to the surfaces thereof, such that the concentration of additive toward the surface of each fiber is greater than the average concentration of additive in the more central region of the fiber and imparts to the surface of the fiber at least one desired characteristic which otherwise would not be present. The additive is miscible with the polymer at melt extrusion temperatures, under which conditions the additive and the polymer form a metastable solution. As the temperature of the newly formed fiber drops below melt extrusion temperatures, the additive becomes significantly less compatible with the polymer. Concurrent with this marked change in compatibility, the polymer begins to solidify. Both factors contribute to the rapid migration or segregation of the additive toward the surface which takes place in a controllable manner.

The patent refers to the use of different molecular weight additives in order to achieve a complimentary or even synergistic effect. For example, a first additive could be a polysiloxane having a benzotriazolyl substituent and a second additive could be a polysiloxane having a tetraalkylpiperidyl substituent. The molecular weight of the first additive would be chosen to result in the migration of the additive primarily to the interfacial surfaces and effective surfaces of the fibers. The molecular weight of the second additive, however, would be chosen to result in the migration of the additive primarily to the subsurface. According to the patent, radiation which is not absorbed by the first additive would be nullified by the second additive.

Actinic radiation, however, often causes significant reductions in the tensile properties of fibers because of the degradation of polymer throughout the fiber. While the method of stabilizing fibers described in U.S. Pat. No. 4,923,914 as summarized above certainly will delay losses of tensile properties, free radicals which migrate deeper than the subsurface of a fiber in time will adversely affect the tensile properties of the fibers.

SUMMARY OF THE INVENTION

It therefore is an object of the present invention to provide a method of stabilizing polyolefin nonwoven webs against actinic radiation.

This and other objects will be apparent to those having ordinary skill in the art from a consideration of the specification and claims which follow.

Accordingly, the present invention provides a method of stabilizing a polyolefin nonwoven web against actinic radiation, which method comprises the steps of:

(A) melting a mixture which comprises a thermoplastic polyolefin, a first additive, and a second additive;

(B) forming fibers by extruding the resulting melt through a die at a shear rate of from about 50 to about 30,000 $sec^{-1}$ and a throughput of no more than about 5.4 kg/cm/hour;

(C) drawing said fibers; and (D) collecting said fibers on a moving foraminous surface as a web of entangled fibers;

in which:

(1) said first additive is a benzotriazolyl-containing polydialkylsiloxane having a molecular weight in the range of from about 500 to about 1,400 and a polydispersity of from about 1.3 to about 2.5, and is present in an amount of from about 0.5 to about 2.0 percent by weight, based on the amount of thermoplastic polyolefin; and (2) said second additive is a polyalkylpiperidyl-containing polydialkylsiloxane having a molecular weight in the range of from about 1,500 to about 30,400 and a polydispersity of from about 1.3 to about 3.0, and is present in an amount of from about 0.5 to about 2.0 percent by weight, based on the amount of thermoplastic polyolefin. In preferred embodiments, the polyolefin is polypropylene.

DETAILED DESCRIPTION OF THE INVENTION

As described in U.S. Pat. No. 4,923,914, which patent is incorporated herein by reference, a fiber can be considered to consist of two major portions, a surface portion and the core. The latter includes all of the fiber which is not included in the surface. The surface in turn can be considered to have three layers: the interfacial surface, the effective surface, and the subsurface. The interfacial surface in essence is the monomolecular layer of the fiber which is at the air/polymer (or nonfiber/fiber) interface. The effective surface begins at the interfacial surface and extends into the fiber a distance of about 15 Å. The subsurface lies below the effective surface and extends into the fiber to a depth of about 1,000 Å; thus, the subsurface has a thickness of about 985 Å.

In order for the surface of a fiber to exhibit the desired characteristic which is not exemplified by the polymer in the absence of an additive, it is not necessary for the additive to be present at the interfacial surface. Rather, the desired characteristic will be observed if the additive is within about 15 Å of the interfacial surface because of the conformational changes in the additive which occur spontaneously at ambient conditions. Below about 15 Å, however, these conformational changes usually are not sufficient to make the additive effectively available at the interfacial surface.

As described in U.S. Pat. No. 4,923,914, however, the subsurface region is important because additive in that region often can be "coaxed" to move into the effective surface region by the application of gentle heat. Moreover, there are some characteristics which do not require the additive to be at either the interfacial surface or the effective surface for the additive to be effective with respect thereto, i.e., ultraviolet radiation stability and degradation inhibition.

It should be noted that the term "core" is used herein differently from the term "bulk". As already pointed out, the former term refers to that portion or region of the fiber or film which is below the subsurface layer or region. The term "bulk", on the other hand, has reference to the entire fiber, including the surface.

In general, the term "thermoplastic polyolefin" is used herein to mean any thermoplastic polyolefin which can be used for the preparation of nonwoven webs. Examples of thermoplastic polyolefins include polyethylene, polypropylene, poly(1-butene), poly(2-butene), poly(1-pentene), poly(2-pentene), poly(3-methyl-1-pentene), poly(4-methyl-1-pentene), 1,2-poly-1,3-butadiene, 1,4-poly-1,3-butadiene, polyisoprene, polychloroprene, polyacrylonitrile, poly(vinyl acetate), poly(vinylidene chloride), polystyrene, and the like.

The preferred polyolefins are those which contain only hydrogen and carbon atoms and which are prepared by the addition polymerization of one or more unsaturated monomers. Examples of such polyolefins include, among others, polyethylene, polypropylene, poly(1-butene), poly(2-butene), poly(1-pentene), poly(2-pentene), poly(3-methyl-1-pentene), poly(4-methyl-1-pentene), 1,2-poly-1,3-butadiene, 1,4-poly-1,3-butadiene, polyisoprene, polystyrene, and the like. In addition, such term is meant to include blends of two or more polyolefins and random and block copolymers prepared from two or more different unsaturated monomers. Because of their commercial importance, the most preferred polyolefins are polyethylene and polypropylene.

The preparation of nonwoven webs in accordance with the present invention involves the steps of:

(A) melting a mixture which comprises a thermoplastic polyolefin, a first additive, and a second additive;

(B) forming fibers by extruding the resulting melt through a die at a shear rate of from about 50 to about 30,000 $sec^{-1}$ and a throughput of no more than about 5.4 kg/cm/hour;

(C) drawing the fibers; and (D) collecting the fibers on a moving foraminous surface as a web of entangled fibers.

The nonwoven webs of the present invention can be prepared by any suitable melt-extrusion process, the most common and well known of which are meltblowing, coforming, and spunbonding.

Meltblowing references include, by way of example, U.S. Pat. Nos. 3,016,599 to R. W. Perry, Jr., 3,704,198 to J. S. Prentice, 3,755,527 to J. P. Keller et al., 3,849,241 to R. R. Butin et al., 3,978,185 to R. R. Butin et al., and 4,663,220 to T. J. Wisneski et al. See, also, V. A. Wente, "Superfine Thermoplastic Fibers", *Industrial and Engineering Chemistry*, Vol. 48, No. 8, pp. 1342–1346 (1956); V. A. Wente et al., "Manufacture of Superfine Organic Fibers", Navy Research Laboratory, Washington, D.C., NRL Report 4364 (111437), dated May 25, 1954, United States Department of Commerce, Office of Technical Services; and Robert R. Butin and Dwight T. Lohkamp, "Melt Blowing—A One Step Web Process for New Nonwoven Products", *Journal of the Technical Association of the Pulp and Paper Industry*, Vol. 56, No. 4, pp. 74–77 (1973).

Coforming references (i.e., references disclosing a meltblowing process in which fibers or particles are comingled with the meltblown fibers as they are formed) include U.S. Pat. Nos. 4,100,324 to R. A. Anderson et al. and 4,118,531 to E. R. Hauser.

Finally, spunbonding references include, among others, U.S. Pat. Nos. 3,341,394 to Kinney, 3,655,862 to Dorschner et al., 3,692,618 to Dorschner et al., 3,705,068 to Dobo et al., 3,802,817 to Matsuki et al., 3,853,651 to Porte, 4,064,605 to Akiyama et al., 4,091,140 to Harmon, 4,100,319 to Schwartz, 4,340,563 to Appel and Morman, 4,405,297 to Appel and Morman, 4,434,204 to Hartman et al., 4,627,811 to Greiser and Wagner, and 4,644,045 to Fowells.

In general, the shear rate required by the method of the present invention will be in the range of from about 50 to about 30,000 $sec^{-1}$. Preferably, the shear rate will be in the range of from about 150 to about 5,000 $sec^{-1}$, and most preferably from about 300 to about 2,000 $sec^{-1}$.

Throughput is of importance because it affects the time the newly formed fiber or film is in a sufficiently molten or fluid state to allow migration or segregation of the additive toward the newly formed surfaces, even though throughput also affects the shear rate.

Throughput typically will be in the range of from about 0.01 to about 5.4 kg/cm/hour. Preferably, throughput will be in the range from about 0.1 to about 4.0 kg/cm.hour. The throughput most preferably will be in the range of from about 0.5 to about 2.5 kg/cm/hour.

The mixture which is melt-extruded must contain, in addition to the thermoplastic polyolefin, a first additive which is a benzotriazolyl-containing polydialkylsiloxane having a molecular weight in the range of from about 500 to about 1,400 and a polydispersity of from about 1.3 to about 2.5, and is present in an amount of from about 0.5 to about 2.0 percent by weight, based on the amount of thermoplastic polyolefin. Suitable benzotriazolyl-containing polydialkylsiloxanes are described in some detail in U.S. Pat. No. 4,923,914. Preferably, the first additive will have a molecular weight in the range of from about 600 to about 900 and a polydispersity of about 1.5 . In addition, the first additive preferably will be present in an amount of about 1.0 percent by weight, based on the amount of the thermoplastic polyolefin.

In addition, the mixture must contain a second additive which is a polyalkylpiperidyl-containing polydialkylsiloxane having a molecular weight in the range of from about 1,500 to about 30,400 and a polydispersity of from about 1.3 to about 3.0, and is present in an amount of from about 0.5 to about 2.0 percent by weight, based on the amount of thermoplastic polyolefin. As with the first additive, suitable polyalkylpiperidyl-containing polydialkysiloxanes are described in some detail in U.S. Pat. No. 4,923,914. Polytetraalkylpiperidyl-containing polydialkylsiloxanes are preferred. The second additive preferably will have a molecular weight in the range of from about 4,000 to about 11,000 and a polydispersity of about 1.5. The second additive preferably will be present in an amount of about 1.0 percent by weight, based on the amount of the thermoplastic polyolefin.

As used herein with respect to both the first and second additives, the term "alkyl" means $C_1$–$C_3$ alkyl groups. The preferred alkyl group is methyl. In addition, the term "polydispersity" refers to the ratio of the weight-average molecular weight to the number-average molecular weight.

While either additive can be either a liquid or a solid, a liquid is preferred. It also is preferred that a liquid first additive have a surface tension which is less than that of virgin polymer.

Having thus described the invention, numerous changes and modifications thereof will be readily apparent to those having ordinary skill in the art without departing from the spirit or scope of the invention.

What is claimed is:

1. A method of stabilizing a polyolefin nonwoven web against actinic radiation which comprises the steps of:

(A) melting a mixture which comprises a thermoplastic polyolefin, a first additive, and a second additive;

(B) forming fibers by extruding the resulting melt through a die at a shear rate of from about 50 to about 30,000 $sec^{-1}$ and a throughput of no more than about 5.4 kg/cm/hour;

(C) drawing said fibers; and (D) collecting said fibers on a moving foraminous surface as a web of entangled fibers;

in which:

(1) said first additive is a benzotriazolyl-containing polydialkylsiloxane having a molecular weight in the range of from about 600 to about 900 and a polydispersity of from about 1.3 to about 2.5, and is present in an amount of from about 0.5 to about 2.0 percent by weight, based on the amount of thermoplastic polyolefin; and (2) said second additive is a polyalkylpiperidyl-containing polydialkylsiloxane having a molecular weight in the range of from about 4,000 to about 11,000 and a polydispersity of from about 1.3 to about 3.0, and is present in an amount of from about 0.5 to about 2.0 percent by weight, based on the amount of thermoplastic polyolefin.

2. The method of claim 1, in which said polyolefin is polypropylene

3. The method of claim 1, in which said first additive is a benzotriazolyl-containing polydimethylsiloxane.

4. The method of claim 1, in which said first additive has a polydispersity of about 1.5 and is present in an amount of about 1.0 percent by weight, based on the amount of thermoplastic polyolefin.

5. The method of claim 1, in which said second additive is a tetraalkylpiperidyl-containing polydialkylsiloxane.

6. The method of claim 1, in which said second additive is a tetraalkylpiperidyl-containing polydimethylsiloxane.

7. The method of claim 1, in which said second additive has a polydispersity of about 1.5 and is present in an amount of about 1.0 percent by weight, based on the amount of thermoplastic polyolefin.

8. The method of claim 1, in which the shear rate is from about 150 to about 5,000 $sec^{-1}$.

9. The method of claim 1, in which the throughput is in the range of from about 0.1 to about 4.0 kg/cm/hour.

* * * * *